US012281652B2

(12) United States Patent
Cho

(10) Patent No.: US 12,281,652 B2
(45) Date of Patent: Apr. 22, 2025

(54) PUMP HAVING OUTER GEAR AND INNER GEAR

(71) Applicant: LG INNOTEK CO., LTD., Seoul (KR)

(72) Inventor: Hyun Shik Cho, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 146 days.

(21) Appl. No.: 17/772,624

(22) PCT Filed: Oct. 7, 2020

(86) PCT No.: PCT/KR2020/013675
§ 371 (c)(1),
(2) Date: Apr. 28, 2022

(87) PCT Pub. No.: WO2021/101063
PCT Pub. Date: May 27, 2021

(65) Prior Publication Data

US 2022/0341420 A1 Oct. 27, 2022

(30) Foreign Application Priority Data

Nov. 21, 2019 (KR) ..... 10-2019-0150618

(51) Int. Cl.
*F04C 2/10* (2006.01)
*F04C 15/00* (2006.01)

(52) U.S. Cl.
CPC ..... *F04C 2/103* (2013.01); *F04C 15/00* (2013.01); *F04C 2240/30* (2013.01); *F04C 2240/40* (2013.01)

(58) Field of Classification Search
CPC ..... F04C 2/102; F04C 2/103; F04C 15/00; F04C 15/008; F04C 2240/30; F04C 2240/40
USPC ..... 417/355, 356
See application file for complete search history.

(56) References Cited

U.S. PATENT DOCUMENTS

| | | | | |
|---|---|---|---|---|
| H1966 | H | 6/2001 | Henry, IV et al. | |
| 11,316,400 | B2 | 4/2022 | Byeon | |
| 2012/0164009 | A1 | 6/2012 | Sakata | |
| 2014/0086766 | A1* | 3/2014 | Chikaoka | F04D 13/06 310/156.01 |

(Continued)

FOREIGN PATENT DOCUMENTS

| | | |
|---|---|---|
| CN | 1702327 | 11/2005 |
| CN | 103237988 | 8/2013 |

(Continued)

OTHER PUBLICATIONS

Chinese Office Action dated Mar. 31, 2023 issued in Application No. 202080080174.7.

(Continued)

*Primary Examiner* — Kenneth J Hansen
*Assistant Examiner* — Chirag Jariwala
(74) *Attorney, Agent, or Firm* — KED & Associates LLP

(57) ABSTRACT

This pump comprises: a housing; a stator which is disposed in the housing and comprises a coil; and pump gears disposed so as to correspond to the stator, wherein the pump gears comprise an outer gear and an inner gear, which is disposed inside the outer gear, and the outer gear is formed of magnetic material.

16 Claims, 10 Drawing Sheets

(56) References Cited

U.S. PATENT DOCUMENTS

| | | | | |
|---|---|---|---|---|
| 2015/0082575 | A1* | 3/2015 | Kimura et al. | H02P 6/153<br>318/400.14 |
| 2019/0249661 | A1* | 8/2019 | Wang et al. | F04C 11/008 |
| 2019/0323500 | A1* | 10/2019 | Medoro | F04C 2/102 |

FOREIGN PATENT DOCUMENTS

| | | | | | |
|---|---|---|---|---|---|
| DE | 11-2017-004041 | | | 5/2019 | |
| JP | 2000-286117 | A | | 10/2000 | |
| JP | 2003-129966 | | | 5/2003 | |
| JP | 2005207248 | A | * | 8/2005 | F04C 15/008 |
| JP | 2006-177291 | | | 7/2006 | |
| JP | 5141956 | B2 | * | 2/2013 | F04C 2/10 |
| JP | 2013-234597 | | | 11/2013 | |
| JP | 2013245611 | A | * | 12/2013 | F04C 2/10 |
| JP | 2017-135269 | A | | 8/2017 | |
| KR | 10-0910434 | | | 8/2009 | |
| KR | 20150112245 | A | * | 10/2015 | F04C 15/00 |
| WO | WO 2007/004503 | | | 1/2007 | |
| WO | WO 2019-074290 | A2 | | 4/2019 | |

OTHER PUBLICATIONS

International Search Report dated Jan. 19, 2021 issued in Application No. PCT/KR2020/013675.
European Search Report dated Nov. 9, 2023 issued in Application No. 20891154.5.
Japanese Office Action dated Apr. 16, 2024 issued in Application 2022-528152.

* cited by examiner

PUMP HAVING OUTER GEAR AND INNER GEAR

CROSS-REFERENCE TO RELATED PATENT APPLICATIONS

This application is a U.S. National Stage Application under 35 U.S.C. § 371 of PCT Application No. PCT/KR2020/013675, filed Oct. 7, 2020, which claims priority to Korean Patent Application No. 10-2019-0150618, filed Nov. 21, 2019, whose entire disclosures are hereby incorporated by reference.

TECHNICAL FIELD

The present embodiment relates to a pump.

BACKGROUND ART

A pump serves to discharge the amount of flow at a constant pressure. The oil circulated by the pump can be used to operate a hydraulic system using hydraulic pressure, or for a cooling or lubricating effect.

A mechanical oil pump (MOP) is an oil pump that operates using the power of a machine such as an engine.

Recently, research on hybrid vehicles and electric vehicles has been actively conducted for the purpose of improving fuel efficiency and reducing carbon emissions.

Accordingly, the demand for an electric oil pump (EOP) operated by a motor instead of a mechanical oil pump (MOP) operated by the power of a machine such as an engine is increasing.

The EOP has a pump-integrated structure in which the housing of the pump and the housing of the motor are integrated. Such a pump-integrated structure has advantages of reduced volume and light weight, but may cause damage to the pump when assembling the motor.

The EOP may typically include a motor region and a pump region. The motor region includes a stator, a rotor, and a rotation shaft. The pump region includes an inner rotor coupled to one end of the rotation shaft to receive rotational force from the rotation shaft, and an outer rotor accommodating the inner rotor.

According to the EOP having the above structure, there is a problem in that the motor part and the pump part in a single pump exist independently, thereby increasing the number of parts. In addition, there is a problem in that the overall size of the product increases as the length increases in the axial direction.

DETAILED DESCRIPTION OF THE INVENTION

Technical Subject

The present invention has been proposed to improve the above problems, and it is to provide a pump capable of reducing the manufacturing cost owing to the reduction in the number of parts, and enabling the miniaturization thereof.

Technical Solution

As an embodiment, a pump comprises: a housing; a stator which is disposed in the housing and includes a coil; and pump gears disposed so as to correspond to the stator, wherein the pump gears include an outer gear and an inner gear being disposed inside the outer gear, and the outer gear is formed of magnetic material.

The inner circumferential surface of the outer gear includes a concave portion and a convex portion, wherein the convex portion may be closer to the center of the outer gear than the concave portion.

The number of poles of the outer gear may correspond to the number of the convex portions.

The outer gear includes a first polarity portion having a first polarity and a second polarity portion having a second polarity opposite to the first polarity, wherein the first polarity portion and the second polarity portion are alternately disposed in a circumferential direction.

The convex portion may be disposed in the center of an inner surface of the first polarity portion or the second polarity portion.

A second partition wall whose inner circumferential surface is forming an inner surface of the space portion may be disposed between the stator and the outer gear.

The housing includes a first partition wall dividing a first area and a second area, wherein a circuit board is disposed in the first area, and wherein the pump gears may be disposed in the second area.

The inner gear includes a hole penetrating from an upper surface to a lower surface, wherein a protrusion being protruded downward and being coupled to the hole may be disposed on a lower surface of the first partition wall.

On a lower surface of the first partition wall, a guide being protruded downward may be disposed so as to surround at least a portion of an outer circumferential surface of the outer gear.

The first area includes a first space, wherein the first space and the second space may not be connected by the partition wall.

Advantageous Effects

According to the present invention, since the rotation shaft for transmitting the rotational force of the motor region to the pump region in the pump according to the conventional structure becomes unnecessary, there is an advantage in that the number of parts is reduced, thereby lowering the manufacturing cost.

In addition, in the conventional structure in which the motor region and the pump region are partitioned in up and down directions, since the length in up and down directions is formed to be short by removing the rotation shaft, there is an advantage in that the product can be miniaturized.

In addition, since the space in which the fluid is accommodated with other regions is divided through a partition wall, there is an advantage in that the leaking of the fluid to other regions can be prevented. In particular, there is an advantage that the stator can be protected from fluid by embedding the stator inside the housing.

In addition, there is an advantage in that noise can be reduced by disposing the outer and inner gears, which are the main causes of noise, in the innermost space of the housing.

BEST MODE

Hereinafter, preferred embodiments of the present invention will be described in detail with reference to the accompanying drawings.

However, the technical idea of the present invention is not limited to some embodiments to be described, but may be implemented in various forms, and within the scope of the technical idea of the present invention, one or more of the constituent elements may be selectively combined or substituted between embodiments.

In addition, the terms (including technical and scientific terms) used in the embodiments of the present invention, unless explicitly defined and described, can be interpreted as a meaning that can be generally understood by a person skilled in the art, and commonly used terms such as terms defined in the dictionary may be interpreted in consideration of the meaning of the context of the related technology.

In addition, terms used in the present specification are for describing embodiments and are not intended to limit the present invention.

In the present specification, the singular form may include the plural form unless specifically stated in the phrase, and when described as "at least one (or more than one) of A and B and C", it may include one or more of all combinations that can be combined with A, B, and C.

In addition, in describing the components of the embodiment of the present invention, terms such as first, second, A, B, (a), and (b) may be used. These terms are merely intended to distinguish the components from other components, and the terms do not limit the nature, order or sequence of the components.

And, when a component is described as being 'connected', 'coupled' or 'interconnected' to another component, the component is not only directly connected, coupled or interconnected to the other component, but may also include cases of being 'connected', 'coupled', or 'interconnected' due that another component between that other components.

In addition, when described as being formed or arranged in "on (above)" or "below (under)" of each component, "on (above)" or "below (under)" means that it includes not only the case where the two components are directly in contact with, but also the case where one or more other components are formed or arranged between the two components. In addition, when expressed as "on (above)" or "below (under)", the meaning of not only an upward direction but also a downward direction based on one component may be included.

Figure 1:
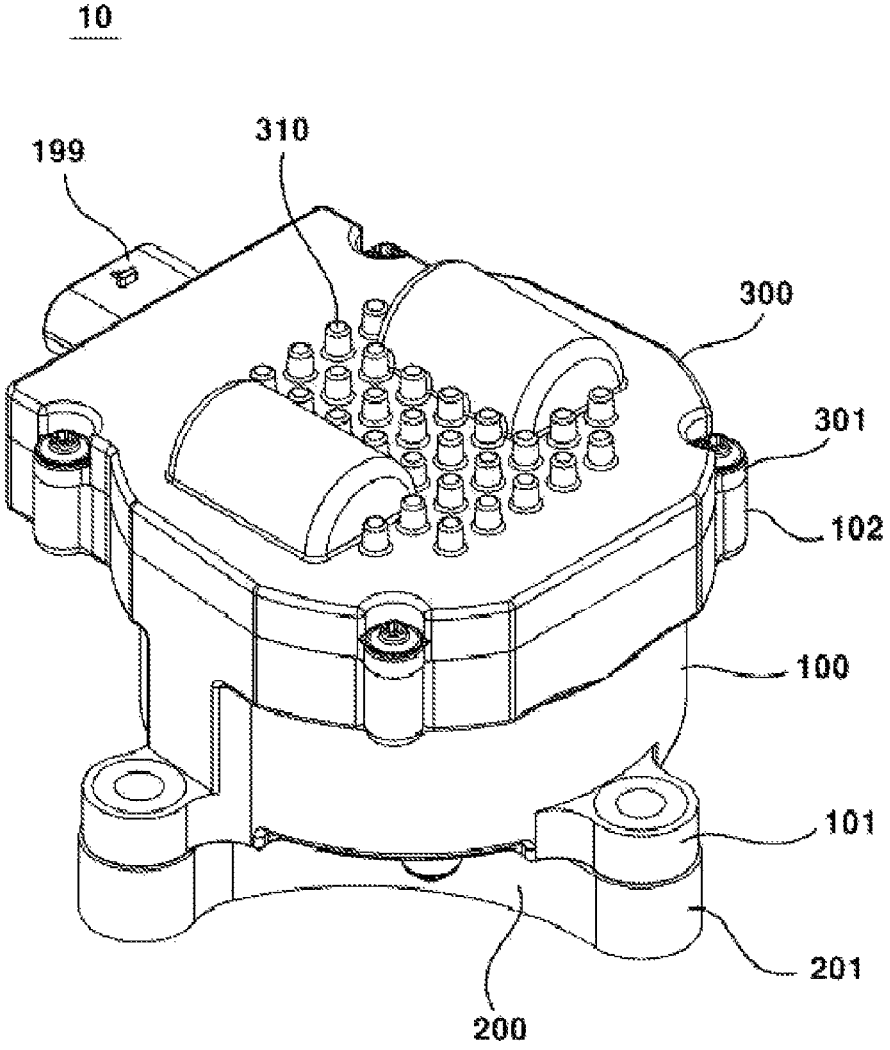
FIG. 1 is a perspective view of a pump according to an embodiment of the present invention.
Figure 2:
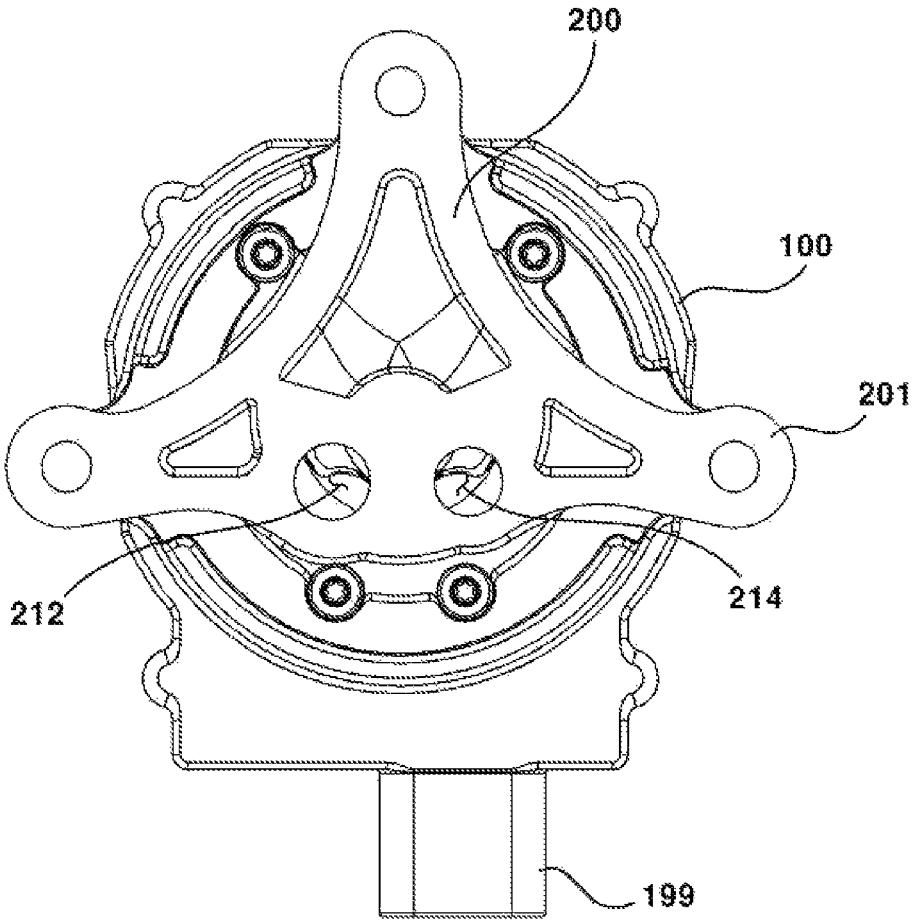
FIG. 2 is a plan view illustrating a lower surface of a pump according to an embodiment of the present invention.
Figure 3:
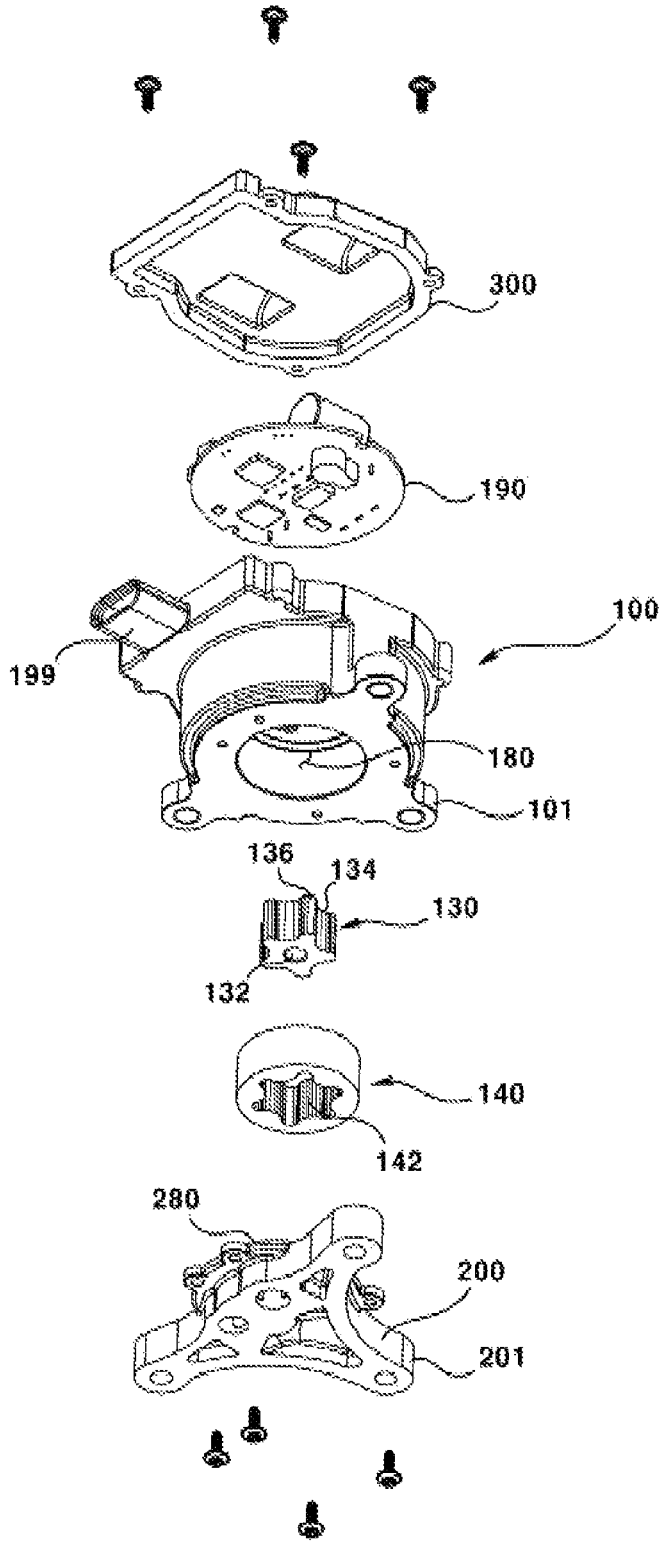
FIG. 3 is an exploded perspective view of a pump according to an embodiment of the present invention.
Figure 4:
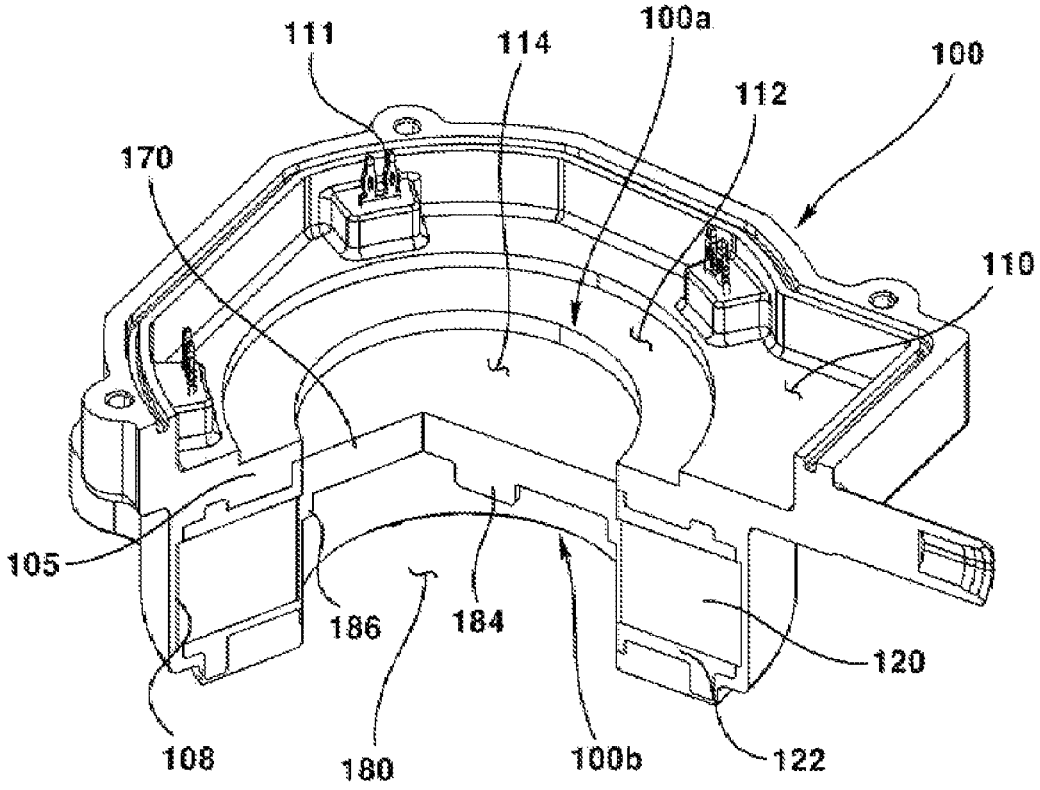
FIG. 4 is a perspective view illustrating a portion of the housing and the stator according to an embodiment of the present invention are cut open.
Figure 5:
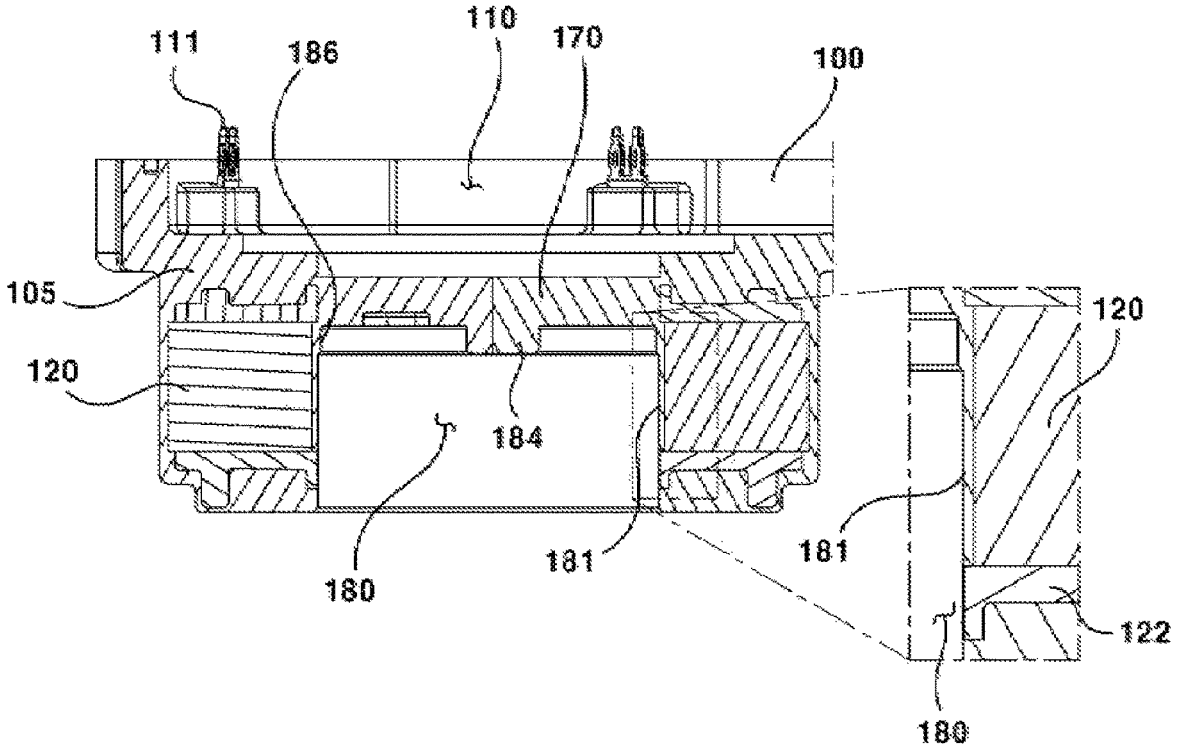
FIG. 5 is a cross-sectional view of a housing according to an embodiment of the present invention.
Figure 6:
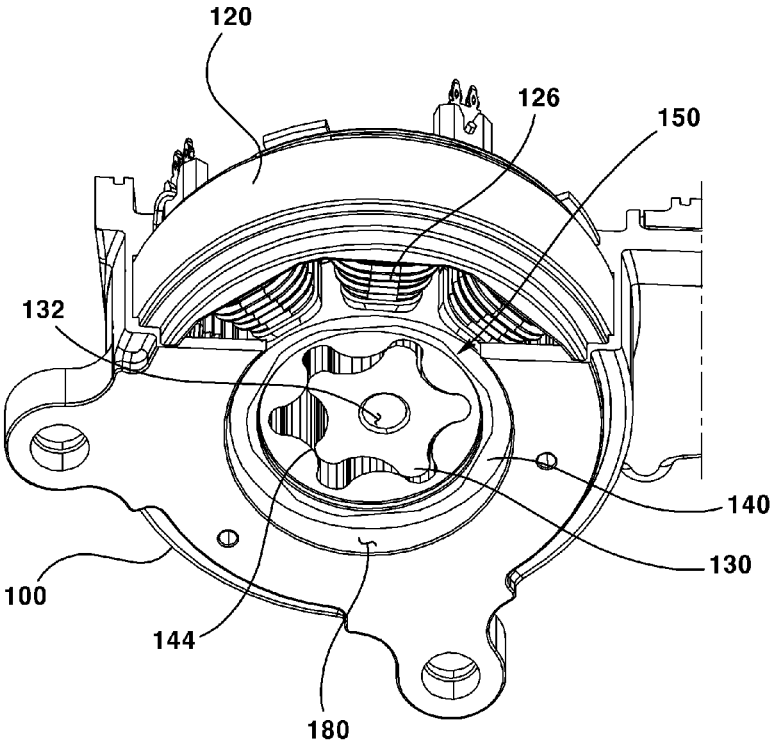
FIG. 6 is a perspective view illustrating a portion of the housing according to an embodiment of the present invention is cut open.
Figure 7:
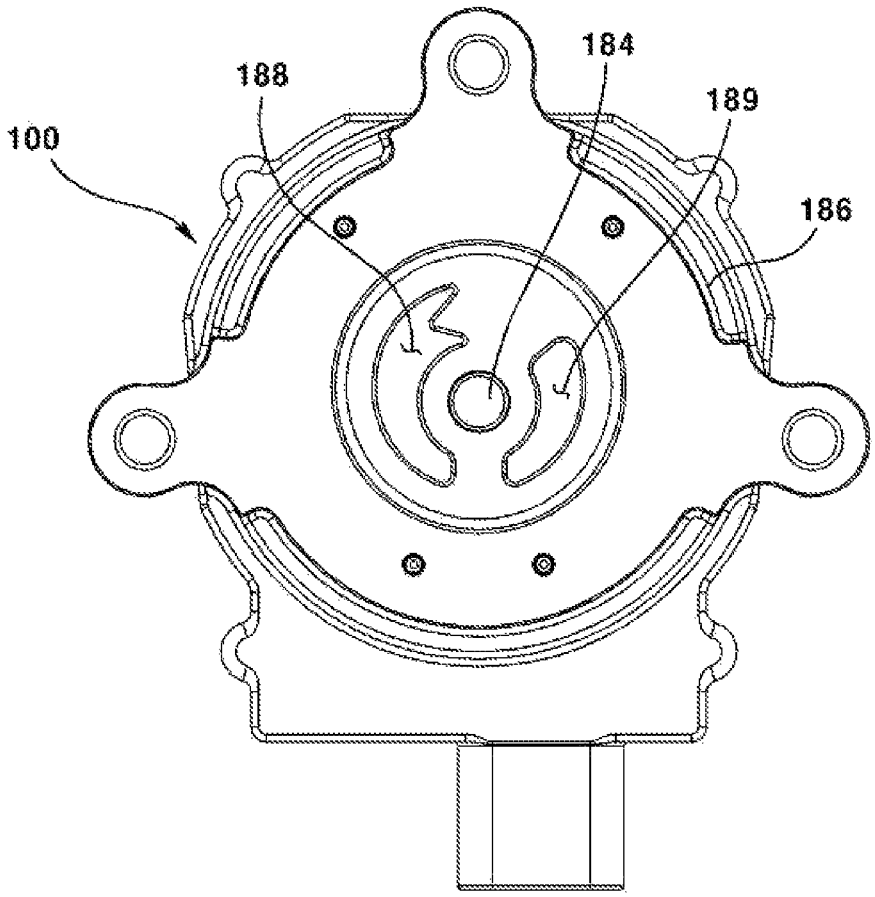
FIG. 7 is a plan view illustrating a lower surface of a partition wall according to an embodiment of the present invention.

FIG. 1 is a perspective view of a pump according to an embodiment of the present invention; FIG. 2 is a plan view illustrating a lower surface of a pump according to an embodiment of the present invention; FIG. 3 is an exploded perspective view of a pump according to an embodiment of the present invention; FIG. 4 is a perspective view illustrating a portion of the housing and the stator according to an embodiment of the present invention are cut open; FIG. 5 is a cross-sectional view of a housing according to an embodiment of the present invention; FIG. 6 is a perspective view illustrating a portion of the housing according to an embodiment of the present invention is cut open; and FIG. 7 is a plan view illustrating a lower surface of a partition wall according to an embodiment of the present invention.

Referring to FIGS. 1 to 7, an external shape of the pump 10 according to an embodiment of the present invention may be formed by coupling of a housing 100, a second cover 200, and a first cover 300.

With respect to the housing 100, the second cover 200 may be coupled to a lower surface of the housing 100. The first cover 300 may be coupled to an upper surface of the housing 100. The housing 100 and the second cover 200 may include a first coupling part 101 and a second coupling part 201 to which screws are screwed, respectively. Accordingly, the housing 100 and the second cover 200 may be screw-coupled through the screws. The housing 100 and the first cover 300 may include a third coupling part 102 and a fourth coupling part 301 to which screws are screw-coupled. Accordingly, the housing 100 and the first cover 300 may be screw-coupled.

On one surface of the second cover 200, a first opening 212 through which the fluid is sucked, and a second opening 214 through which the circulated fluid is discharged may be formed. On the other surface of the cover 200, a third opening 232 connected to the first opening 212 and a fourth opening 234 connected to the second opening 214 may be formed.

On an upper surface of the second cover 200, a mounting part 280 being protruded upwardly and coupled to a second space 180 (refer to FIG. 4) inside the housing 100, which will be described later, may be formed. A cross-section of the mounting part 280 may be circular. A screw thread or a screw groove may be formed on an outer circumferential surface of the mounting part 280. In addition, a screw thread or a screw groove may be formed on an inner circumferential surface of the second space 180 facing an outer circumferential surface of the mounting part 280. For this reason, the mounting part 280 may be screw-coupled to an inner circumferential surface of the second space 180. A cross-sectional shape of the mounting part 280 may correspond to a cross-sectional shape of the second space 180. A ring-shaped sealing member (not shown) for sealing the second space 180 may be disposed on an outer circumferential surface of the mounting part 280. The sealing member may be formed of a rubber material to prevent a fluid from leaking between an outer circumferential surface of the mounting part 280 and an inner circumferential surface of the second space 180.

A third opening 232 through which the fluid is being sucked and a fourth opening 234 through which the fluid that has been sucked is discharged may be formed on an upper surface of the second cover 200. The fluid may be oil. Each of the third opening 232 and the fourth opening 234 may be formed to have an arc shape, and may be provided such that the gap becomes gradually narrower as it travels from one side to the other. More specifically, it may be disposed in a way that the wide side of the gap of the third opening 232 faces the wide side of the gap of the fourth opening 234, and the narrow side of the gap of the third opening 232 faces the narrow side of the gap of the fourth opening.

In a present embodiment, the cross-sectional area of the third opening 232 is formed to be larger than that of the fourth opening 234 as an example, but the cross-sectional area of the fourth opening 234 may be formed to be larger than that of the third opening 232.

The third opening 232 and the fourth opening 234 may be disposed on an upper surface of the mounting part 280.

A first space 110 may be formed on an upper surface of the housing 100. The first space 110 may have a groove shape. A plurality of electronic components for driving may be disposed in the first space 110. For example, in the first space 110, a circuit board 190 and a terminal 111 may be disposed. A plurality of devices may be mounted on the circuit board 190. A connector 199 may be disposed on a side surface of the housing 100. The connector 199 may be electrically connected to the circuit board 190. An external terminal may be coupled to the connector 199. For this reason, power may be applied to the pump 10 or a signal for driving may be transmitted or received.

In a bottom surface of the first space 110, a fifth groove 112 that is formed by being more recessed compared to other regions may be included. A cross-sectional shape of the fifth groove 112 may be disposed to correspond to a cross-sectional shape of the circuit board 190. Due to this, the circuit board 190 may be firmly fixed on the fifth groove 112.

A sixth groove 114 that is formed by being more recessed compared to other regions may be disposed on the bottom surface of the fifth groove 112. A portion of the lower surface of the circuit board 190 may be disposed to be spaced apart from the bottom surface of the sixth groove 114 due to the sixth groove 114.

The first cover 300 may be coupled to an upper portion of the housing 100 so as to cover the first space 110. A plurality of heat dissipation fins 310 being protruded upward may be disposed on an upper surface of the first cover 300. The cross-sectional area of the first cover 300 may be increased through the heat dissipation fins 310. Accordingly, heat generated in the first space 110 may be dissipated.

A stator 120 and the pump gears 150 may be disposed in the housing 100. The pump gears 150 may include an outer gear 140 and an inner gear 130. The inner gear 130 may be disposed inside the outer gear 140.

The housing 100 may be formed of a resin or plastic material.

The housing 100 may include a first partition wall 170 that divides the first region 100*a* from the second region 100*b*, and a body 105. The first region 100*a* may include a first space 110. The second region may include a second space 180 defined by the first partition wall 170 and the body 105. The first space 110 and the second space 180 may not be connected by the first partition wall 170.

The stator 120 may be disposed inside the housing 100. The stator 120 may be inserted into the body 105. At least a portion of the body 105 may be disposed between the stator 120 and the pump gears 150.

The stator 120 may be integrally formed with the housing 100 by double injection. The stator 120 and the housing 100 may be integrally formed by insert injection. The stator 120 may be molded inside the body 105 and accommodated inside the housing 100. A stator accommodating space 108 in which the stator 120 is being disposed may be formed inside the housing 100. The stator accommodating space 108 may be disposed outside the second space 180. The outer surface of the stator 120 may be surrounded by the housing 100.

The stator 120 may include a core and a coil 126 being wound around the core. The stator 120 may include an insulator 122 being disposed to surround the outer surface of the core. The coil 126 may be wound on an outer surface of the insulator 122. The terminal 111 may be disposed on the first space 110 so as to be coupled to the circuit board 190 and the coil 126. Accordingly, at least a portion of the insulator 122 may be exposed to the outside of the body. In addition, the stator 120 may be molded in the body 105 so as not to be exposed to the outside of the body 105.

The second space 180 may be disposed in a central region of the housing 100. The second space 180 may have a groove shape in which a portion of a lower surface of the housing 100 is being recessed upward. The arrangement region of the stator 120 and the second space 180 may be partitioned by a second partition wall 181. In other words, the second partition wall 181 may be disposed between the core and the outer gear 140 to be described later. The second partition wall 181 may be formed to a thickness of 0.2 mm to 1 mm.

The second space 180 and the first space 110 may be partitioned in up and down directions by the first partition wall 170. A lower surface of the first partition wall 170 may form an upper surface of the second space 180. The second space 180 and the first space 110 may be partitioned into different regions through the first partition wall 170. Accordingly, it is possible to prevent the fluid inside the second space 180 from flowing into the first space 110 in advance.

The outer gear 140 and the inner gear 130 may be disposed in the second space 180

The outer gear 140 may be disposed inside the stator 120. The second partition wall 181 may be disposed between the outer gear 140 and the stator 120.

The outer gear 140 may be formed in a circular shape, and a first hole 142 penetrating from an upper surface to a lower surface may be formed in the center. A plurality of convex portions 144 being protruded inward from an inner circumferential surface and concave portions 146 disposed between the plurality of convex portions 144 may be formed on an inner circumferential surface of the first hole 142. That is, a first gear in which a plurality of convex portions 144 and concave portions 146 are alternately disposed along the circumferential direction may be formed on an inner circumferential surface of the first hole 142.

The inner gear 130 may be disposed inside the outer gear 140. The outer gear 140 may be called an outer rotor, and the inner gear 130 may be called an inner rotor. The inner gear 130 and the outer gear 140 may be disposed so that the centers do not coincide with each other.

The outer circumferential surface of the inner gear 130 may include a plurality of convex portions 136 being protruded outward from the outer circumferential surface and concave portions 134 disposed between the plurality of convex portions 136. A second gear in which a plurality of convex portions 136 and a plurality of concave portions 133 are alternately disposed may be formed on an outer circumferential surface of the inner gear 130.

In other words, in the inner gear 130, the second lobe 136 having N number of gear teeth may be disposed along the circumferential direction outward in the radial direction with respect to the rotation center. The outer gear 140 may be provided with N+1 number of the convex portions 144 inward in the radial direction. The convex portion 144 may be disposed to be caught by the second lobe 136. When the outer gear 140 is rotated, the inner gear 130 may be rotated by the convex portion 144 and the second lobe 136. According to the rotation of the inner gear 130, the fluid may be introduced into the second space 180 or the fluid in the second space 180 may be discharged to the outside.

In summary, by the eccentricity of the outer gear 140 and the inner gear 130, a volume capable of transporting the fluid fuel is generated between the outer gear 140 and the inner gear 130 so that the portion with the increased volume sucks the surrounding fluid due to pressure drop, and the portion with the reduced volume discharges the fluid due to the increase in pressure.

Meanwhile, on an upper surface of the second space 180, that is, a lower surface of the first partition wall 170, a guide 186 being protruded downward may be formed. The guide 186 may be formed in a ring shape so that an inner circumferential surface thereof may face an outer circumferential surface of the outer gear 140. The cross-sectional shape of the inner circumferential surface of the guide 186 may be formed to correspond to the cross-sectional shape of an outer circumferential surface of the outer gear 140. Accordingly, the outer gear 140 may be rotated by being guided by an inner circumferential surface of the outer gear 140.

Unlike this, on an upper portion of the outer gear 140, a guide part 141 may be formed to be stepped more upward than other regions, and disposed inside the guide 186. In this case, the guide part 141 may have a smaller cross-sectional area than other regions of the outer gear 140.

The height of the guide 186 being protruded from the lower surface of the first partition wall 170 may be formed to be smaller than one half of the height of the second space 180.

On the upper surface of the second space 180 and the lower surface of the first partition wall 170, a first protrusion 184 being protruded downward in a direction toward the pump gears 150 may be formed. In addition, a first groove 132 may be formed in the pump 150 so that the first protrusion 184 is coupled thereto. More specifically, the first groove 132 may be formed in the center of the inner gear 130 to penetrate through the lower surface from the upper surface. The first protrusion 184 may be coupled to the first groove 132. That is, the first protrusion 184 may form a rotation center of the inner gear 130. Accordingly, the first protrusion 184 supports the rotation of the inner gear 130 inside the second space 180.

The height of the first protrusion 184 being protruded from the lower surface of the first partition wall 170 may be formed to be smaller than one half of the height of the second space 180.

A third groove 188 and a fourth groove 189 may be formed on a lower surface of the first partition wall 170. Each of the third groove 188 and the fourth groove 189 may have a groove shape that is recessed more upward than other region or a lower surface of the first partition wall 170. The third groove 188 may be in the shape being overlapped with the first opening 212 or the third opening 232 in up and down directions. The fourth groove 189 may be in the shape being overlapped with the second opening 214 or the fourth opening 234. That is, the cross-sectional shape of the third groove 188 corresponds to the cross-sectional shape of the first opening 212 or the third opening 232, and the cross-sectional shape of the fourth groove 189 may be formed to correspond to the cross-sectional shape of the second opening 214 or the fourth opening 234. Accordingly, the hydraulic pressure balance of the fluid in the second space 180 can be maintained.

The first protrusion 184 may be disposed between the third groove 188 and the fourth groove 189.

According to the structure as described above, since the rotation shaft for transmitting the rotational force of the motor region to the pump region in the pump according to the conventional structure becomes unnecessary, there is an advantage in that the number of parts is reduced, and due to this, there is an advantage in that the manufacturing cost can be lowered.

In addition, in the conventional structure in which the motor region and the pump region are partitioned in up and down directions, since the length in up and down directions is formed to be short by removing the rotation shaft, there is an advantage in that the product can be miniaturized.

In addition, since the space in which the fluid is accommodated with other regions is divided through a partition wall, there is an advantage in that the leaking of the fluid to other regions can be prevented. In particular, there is an advantage that the stator can be protected from fluid by embedding the stator inside the housing.

In addition, there is an advantage in that noise can be reduced by disposing the outer and inner gears, which are the main causes of noise, in the innermost space of the housing.

Figure 8:
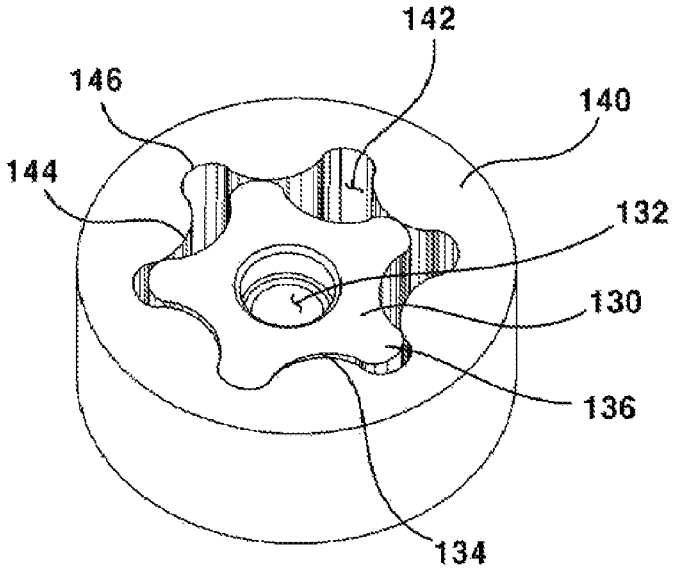
FIG. 8 is a perspective view showing the coupling of an outer gear and an inner gear according to an embodiment of the present invention.
Figure 9:
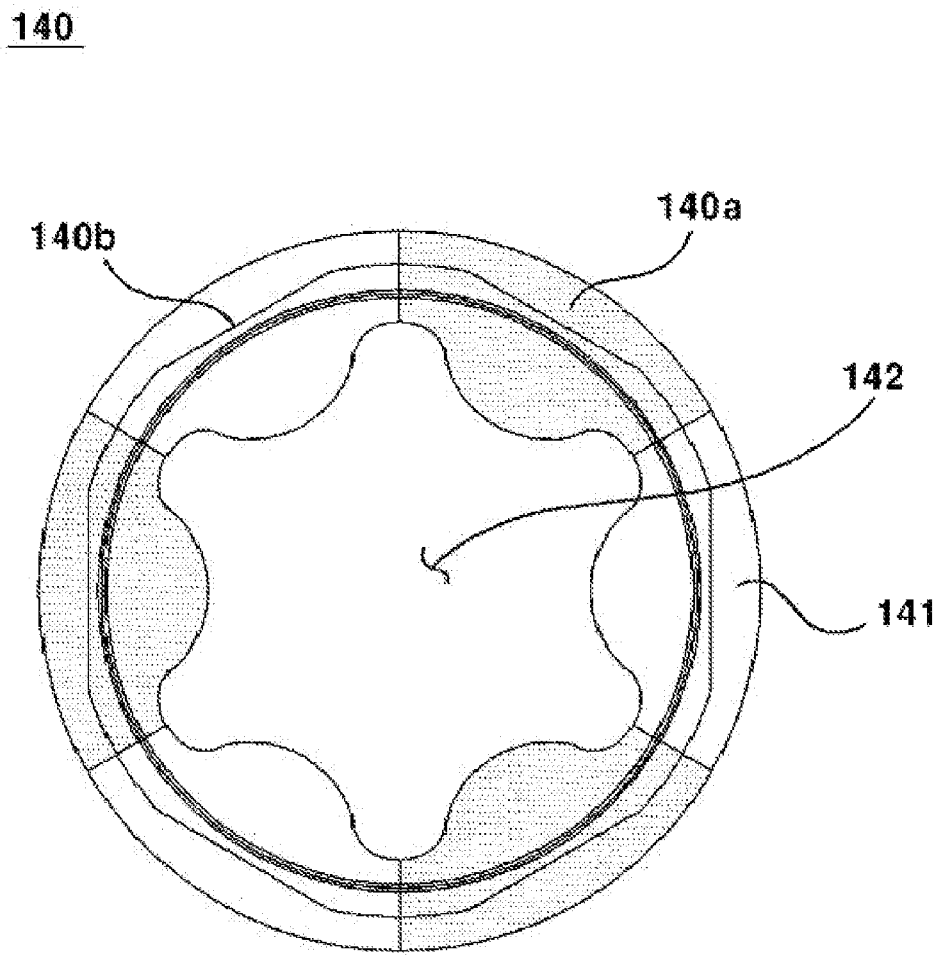
FIG. 9 is a plan view illustrating an upper surface of an outer gear according to an embodiment of the present invention.

FIG. 8 is a perspective view showing the coupling of an outer gear and an inner gear according to an embodiment of the present invention; FIG. 9 is a plan view illustrating an upper surface of an outer gear according to an embodiment of the present invention; and FIG. 10 is a plan view illustrating a lower surface of an outer gear according to an embodiment of the present invention.

Figure 10:
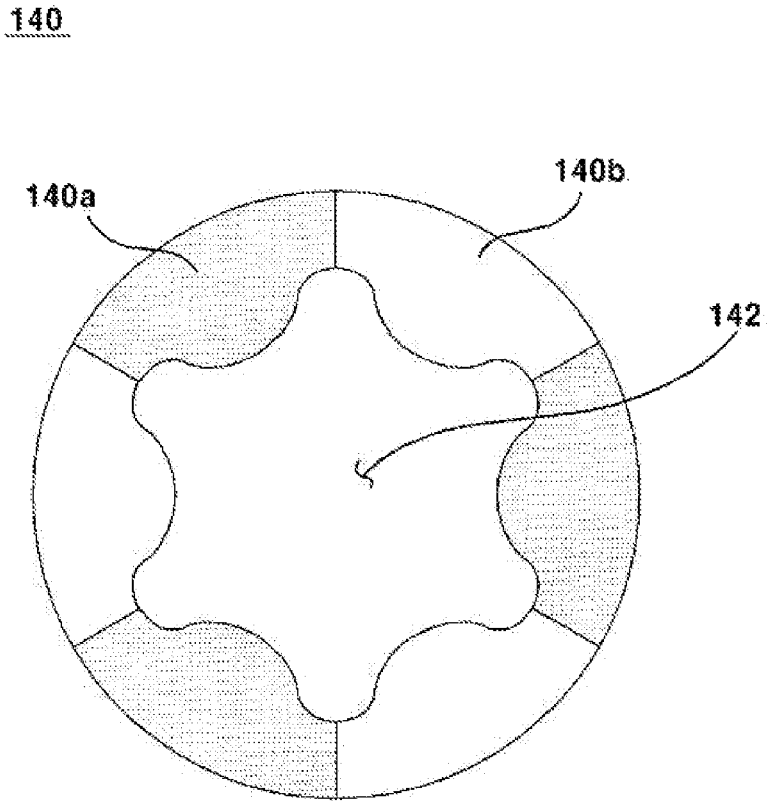
FIG. 10 is a plan view illustrating a lower surface of an outer gear according to an embodiment of the present invention.

Referring to FIGS. 8 to 10, the outer gear 140 according to an embodiment of the present invention may be formed of a magnetic material. The outer gear 140 may be formed of a permanent magnet material. The outer gear 140 may be manufactured by molding by compression of magnetic powder.

The outer gear 140 may be a rare earth bonded magnet manufactured by compression molding powder of a rare earth alloy (Nd—Fe—B alloy). Unlike this, the outer gear 140 may be configured in an extremely anisotropic ferrite sintering method.

As the outer gear 140 is formed of a magnetic material, when a current is applied to the coil 126 of the stator 120, the outer gear 140 may be rotated by the electromagnetic interaction between the stator 120 and the outer gear 140.

The outer gear 140 may include a first polarity portion 140*a* and a second polarity portion 140*b* opposite to the polarity of the first polarity portion 140*a*. The first polarity portion 140*a* and the second polarity portion 140*b* may be alternately disposed along the circumferential direction. For example, the polarity of the first polarity portion 140*a* may be an N pole, and the polarity of the second polarity portion 140*b* may be an S pole. Also, vice versa.

The number of poles of the outer gear 140 may correspond to the number of the convex portions 144. As illustrated in FIGS. 9 and 10, when six convex portions 144 are provided on an inner circumferential surface of the outer gear 140, the outer gear 140 may be formed of a six-pole magnet. In this case, the convex portion 144 may be disposed at the center of the inner surface of each of the polarity portions 140*a* and 140*b*. Accordingly, the outer gear 140 and the inner gear 130 can be rotated more stably inside the stator 120.

In the above description, it is described that all the components constituting the embodiments of the present invention are combined or operated in one, but the present invention is not necessarily limited to these embodiments. In other words, within the scope of the present invention, all of the components may be selectively operated in combination with one or more. In addition, the terms "comprise", "include" or "having" described above mean that the corresponding component may be inherent unless specifically stated otherwise, and thus it should be construed that it does not exclude other components, but further include other components instead. All terms, including technical and scientific terms, have the same meaning as commonly understood by one of ordinary skill in the art unless otherwise defined. Terms used generally, such as terms defined in a dictionary, should be interpreted to coincide with the contextual meaning of the related art, and shall not be interpreted in an ideal or excessively formal sense unless explicitly defined in the present invention.

The above description is merely illustrative of the technical idea of the present invention, and those skilled in the art to which the present invention pertains may make various modifications and changes without departing from the essential characteristics of the present invention. Therefore, the embodiments disclosed in the present invention are not intended to limit the technical idea of the present invention but to describe the present invention, and the scope of the technical idea of the present invention is not limited by these embodiments. The protection scope of the present invention should be interpreted by the following claims, and all technical ideas within the equivalent scope should be interpreted as being included in the scope of the present invention.

The invention claimed is:

1. A pump comprising:

a housing;

a stator which is disposed in the housing and includes a coil;

pump gears disposed so as to correspond to the stator; and a cover to couple to a lower surface of the housing, the cover including a first opening configured to receive fluid, and a second opening configured to discharge circulated fluid, wherein the pump gears include an outer gear and an inner gear being disposed inside the outer gear, wherein the outer gear is formed of a magnetic material, wherein an inner circumferential surface of the outer gear includes concave portions and convex portions, wherein a number of poles of the outer gear corresponds to a number of the convex portions, wherein the housing includes a first partition wall dividing a first area and a second area, wherein a circuit board is disposed in the first area, wherein the pump gears are disposed in the second area, wherein the inner gear includes a hole penetrating from an upper surface of the inner gear to a lower surface of the inner gear, wherein a protrusion is disposed on a lower surface of the first partition wall and is configured to support rotation of the inner gear by protruding through an upper opening of the hole at the upper surface of the inner gear and extending to an area within the hole between the upper opening and a lower opening of the hole at the lower surface of the inner gear, wherein a guide is to protrude downward from the lower surface of the first partition wall, the guide having an inner circumferential surface that faces an outer circumferential surface of the outer gear, wherein the lower surface of the first partition wall includes a first partition groove that is recessed upward from the lower surface of the first partition wall, and a second partition groove that is recessed upward from the lower surface of the first partition wall, the first partition groove is disposed to overlap with the first opening of the cover in an up-down direction and the second partition groove is disposed to overlap with the second opening of the cover in the up-down direction so as to maintain hydraulic pressure balance of the fluid in the second area, and the protrusion is disposed between the first partition groove and the second partition groove on the lower surface of the first partition wall, wherein the inner gear and the outer gear rotate eccentrically, wherein the protrusion is one body with the first partition wall, and wherein a protruding height of the protrusion from the lower surface of the first partition wall is less than ½ of a height of the second area.

2. The pump according to claim 1, wherein the convex portions are closer to a center of the outer gear than the concave portions.

3. The pump according to claim 1, wherein the outer gear is made of permanent magnet material or rare earth alloy material.

4. The pump according to claim 1, wherein the outer gear includes a first polarity portion having a first polarity and a second polarity portion having a second polarity opposite to the first polarity, and wherein the first polarity portion and the second polarity portion are alternately disposed in a circumferential direction.

5. The pump according to claim 4, wherein the convex portions are disposed in a center of an inner surface of the first polarity portion or the second polarity portion.

6. The pump according to claim 1, wherein a second partition wall, whose inner circumferential surface is forming an inner surface of a space portion, is disposed between the stator and the outer gear.

7. The pump according to claim 6, wherein the cover includes a mounting portion coupled to the space portion.

8. The pump according to claim 7, wherein the mounting portion is screw-coupled to the space portion, and wherein a sealing member is disposed between the mounting portion and the inner surface of the space portion.

9. The pump according to claim 1, wherein the stator is molded into the housing.

10. The pump according to claim 9, wherein a material of the housing is resin or plastic.

11. The pump according to claim 1, wherein N lobes are disposed on an outer surface of the inner gear, and wherein the number of the convex portions is N+1.

12. A pump comprising:

a housing comprising a partition wall and a body;

a stator disposed inside the housing and including a coil;

a circuit board disposed on the partition wall;

pump gears disposed under the partition wall; and a cover to couple to a lower surface of the housing, the cover including a first opening configured to receive fluid, and a second opening configured to discharge circulated fluid, wherein the pump gears include an outer gear and an inner gear being disposed inside the outer gear, wherein the outer gear is formed of a magnetic material, wherein an inner circumferential surface of the outer gear includes concave portions and convex portions, wherein a number of poles of the outer gear corresponds to a number of the convex portions, wherein the partition wall dividing a first area and a second area, wherein the circuit board is disposed in the first area, wherein the pump gears are disposed in the second area, wherein the inner gear includes a hole penetrating from an upper surface of the inner gear to a lower surface of the inner gear, wherein a protrusion is disposed on a lower surface of the partition wall and is configured to support rotation of the inner gear by protruding through an upper opening of the hole at the upper surface of the inner gear and extending to an area within the hole between the upper opening and a lower opening of the hole at the lower surface of the inner gear, wherein a guide is to protrude downward from the lower surface of the partition wall, the guide having an inner circumferential surface that faces an outer circumferential surface of the outer gear, wherein the lower surface of the partition wall includes a first partition groove that is recessed upward from the lower surface of the partition wall, and a second partition groove that is recessed upward from the lower surface of the partition wall, the first partition groove is disposed to overlap with the first opening of the cover in an up-down direction and the second partition groove is disposed to overlap with the second opening of the cover in the up-down direction so as to maintain hydraulic pressure balance of the fluid in the second area, and the protrusion is disposed between the first partition groove and the second partition groove on the lower surface of the partition wall, wherein the inner gear and the outer gear rotate eccentrically, wherein the protrusion is one body with the partition wall, and wherein a protruding height of the protrusion from the lower surface of the partition wall is less than ½ of a height of the second area.

13. The pump according to claim 12, wherein the convex portions are closer to a center of the outer gear than the concave portions.

14. The pump according to claim 12, wherein the outer gear is made of permanent magnet material or rare earth alloy material.

15. The pump according to claim 12, wherein the outer gear includes a first polarity portion having a first polarity and a second polarity portion having a second polarity opposite to the first polarity, and wherein the first polarity portion and the second polarity portion are alternately disposed in a circumferential direction.

16. The pump according to claim 15, wherein the convex portions are disposed in a center of an inner surface of the first polarity portion or the second polarity portion.

* * * * *